United States Patent [19]

Jenkins

[11] Patent Number: 4,699,625

[45] Date of Patent: Oct. 13, 1987

[54] METHOD OF CONTINUOUSLY DYEING FABRICS CONTAINING BLENDS OF SYNTHETIC FIBERS AND CELLULOSIC FIBERS WITH PREMETALLIZED DYE AND POLYVINYL PYRROLISON/STYRENE COPOLYMER

[75] Inventor: Evans M. Jenkins, Burlington, N.C.

[73] Assignee: Collins & Aikman Corporation, New York, N.Y.

[21] Appl. No.: 828,723

[22] Filed: Feb. 12, 1986

Related U.S. Application Data

[63] Continuation-in-part of Ser. No. 602,178, Apr. 11, 1984, abandoned.

[51] Int. Cl.[4] ..... D06P 3/82; C09B 67/00

[52] U.S. Cl. ..... 8/532; 8/495; 8/499; 8/553; 8/685

[58] Field of Search ..... 8/495, 499, 532, 553, 8/532, 685

[56] References Cited

U.S. PATENT DOCUMENTS

| | | | |
|---|---|---|---|
| 3,377,412 | 4/1968 | Franks | 8/553 |
| 3,420,616 | 1/1969 | Hirshfeld et al. | 8/474 |
| 3,574,512 | 4/1971 | Weber et al. | 8/510 |
| 3,702,230 | 11/1972 | Blanchard et al. | 8/496 |
| 4,131,422 | 12/1978 | Thomas et al. | 8/478 |
| 4,326,051 | 4/1982 | Suling et al. | 8/510 |
| 4,430,090 | 2/1984 | Buhler et al. | 8/508 |
| 4,501,588 | 2/1985 | Suzuki et al. | 8/444 |

FOREIGN PATENT DOCUMENTS 3441443 5/1985 Fed. Rep. of Germany .

OTHER PUBLICATIONS

Textile Chemist and Colorist, 1981, vol. 13, (No. 4), pp. 37–39.

GAF Polectron 430: Copolymer Emulsion: a Multipurpose Vinyl Pyrrolidone/styrene Copolymer.

*Primary Examiner*—A. Lionel Clingman

*Attorney, Agent, or Firm*—Bell, Seltzer, Park & Gibson

[57] ABSTRACT

Textile fabrics containing blends of synthetic fibers and cellulosic fibers are dyed in a continuous process such that the fibers of each class are substantially colored and a union dyeing is obtained. The method comprises continuously impregnating the fabric with a dyebath composition comprising a premetallized dyestuff and a reactive resin. After impregnation, the fabric is subjected to a temperature of from 280° to 400° F. to dry the fabric and to cure the dyebath composition on the fabric.

7 Claims, No Drawings

METHOD OF CONTINUOUSLY DYEING FABRICS CONTAINING BLENDS OF SYNTHETIC FIBERS AND CELLULOSIC FIBERS WITH PREMETALLIZED DYE AND POLYVINYL PYRROLISON/STYRENE COPOLYMER

CROSS REFERENCE TO RELATED APPLICATION

This application is a continuation-in-part of copending application Ser. No. 602,178, filed Apr. 11, 1984, now abandoned.

FIELD AND BACKGROUND OF THE INVENTION

This invention relates to a method for continuously dyeing textile fabrics containing blends of synthetic fibers and cellulosic fibers.

Fabrics formed of blends of synthetic and cellulosic fibers, such as 50/50 blends of polyester and cotton, 50/50 blends of cotton and acrylic, and 75/25 blends of cotton and nylon for example, pose many problems in dyeing since the different fibers in the blend each have their own dyeing requirements and special peculiarities. In the case of a fabric formed entirely of polyester fibers, a method of dyeing with disperse dye commonly known as the thermosol process may be employed for continuously dyeing the fabric. However, most apparel fabrics are blends of polyester with a cellulosic fiber, as noted above, and these blends cannot be continuously dyed by the thermosol process.

Moreover, different classes of dyestuffs are needed for the different fibers, and the dyeing is usually accomplished in a two-step process. The cellulosic portion of the blend is dyed by a batch method using reactive dyes or direct dyes which require large volumes of water that must be heated to boiling for many hours, and with large amounts of auxiliary chemicals being used. After the cellulosic fibers have been dyed to the correct shade, the polyester or other synthetic portion of the blend is then dyed with disperse dyes with a similar energy/time/chemical requirement.

The disadvantages of the aforementioned multistep dyeing process have been recognized, and attempts have been made to provide a process which overcomes these disadvantages. For example, the publication entitled "A Cost Effective Approach to Dyeing Cotton Tubular Knits", Textile Chemist and Colorist, Volume 13, No. 4, pages 37–39 (April 1981) describes a pad/-batch dyeing process promoted by Cotton Inc. of Raleigh, North Carolina, which is a hybrid of pad dyeing and batch dyeing. However, this pad/batch process still suffers a number of disadvantages and limitations and has not been widely adopted commercially.

It is an object of the present invention to overcome the aforementioned disadvantages and limitations of the prior processes available for dyeing blends of synthetic fibers and cellulosic fibers.

More particularly, it is an object of the present invention to provide a process in which textile fabrics containing blends of synthetic fibers and cellulosic fibers may be continuously dyed quickly and in a cost effective manner.

SUMMARY OF THE INVENTION

In accordance with the present invention, textile materials such as fabrics or yarns are dyed in a continuous manner by impregnating the textile material containing a blend of synthetic fibers and cellulosic fibers with a dyebath composition comprising a dyestuff which by itself would not effectively dye the two classes of fibers and a reactive resin which is capable of curing and binding the dyestuff to the fibers. The impregnated fabric is subjected to a temperature from about 280° to 400° F. for from about 2 to 5 minutes to dry the fabric and to thereby cure the dyebath composition on the fabric. The dyebath may be applied to the fabric by various methods such as by spraying or preferably and quite simply by passing the goods through a padding trough containing the dyebath composition, squeezing to the desired wet pickup, and then passing the goods through conventional drying equipment. An after rinse may be optionally employed if desired depending upon the particular chemicals and dye class being used.

In accordance with a preferred embodiment of the invention, premetallized dyestuffs are employed and the reactive resin is a polyvinyl pyrollidone/styrene copolymer emulsion. This class of resin is commercially available from several sources, such as the GAF Corporation. It is also possible to employ a styrene/butadiene resin, preferably a carboxylated styrene/butadiene resin. When a carboxylated SBR resin is used, it may be desirable to also employ a compatibilizer as recommended by the supplier. Styrene/butadiene resins are commercially available from several sources, including BF Goodrich and Riechold Chemicals Inc. Crosslinking resins of the type conventionally used as durable press finishing agents may also be used in the dyebath composition. Examples of such resins include DMDHEU (Dimethyl dihydroxy ethylene urea), urea formaldehyde resins, triazine resins, etc.

The dyebath composition may also include catalysts of the type conventionally used with the particular resins employed, e.g. those based on Lewis acids such as magnesium chloride or ammonium chloride, or zinc nitrate, for example. The dyebath composition may also contain other commonly used additives, such as fabric softeners, wetting agents, soil release agents, and the like.

Curing temperatures of between 280° to 400° F., preferably between 300° and 380° F., are normally employed. No special mixing requirements are needed beyond those usually followed for the particular class of dyestuffs being used.

The following non-limiting examples illustrate various dyebath formulations in accordance with the present invention and how they may be applied and cured.

EXAMPLE 1

An 8 oz./yd. 50/50 polyester/cotton interlock fabric was padded to an 85% wet pickup with the following bath and dried and cured for 3 minutes at 330° F.

| | |
|---|---|
| Water | 87.0 grams |
| Polyvinyl pyrollidone/styrene copolymer emulsion (Polectron ® 430-GAF Corp.) | 10.0 |
| Premetallized dye (Isolan Navy SR-L) | 1.0 |
| Reactive polysiloxane emulsion (Dow Corning 1111 Emulsion) | 1.0 |
| Nonionic wetting agent (Triton X-100-Rohm and Haas Co.) | 1.0 |

The resulting fabric exhibited washfastness and excellent color yield.

EXAMPLE 2

An 8.0 oz./yd. 50/50 polyester/cotton interlock fabric was padded to a 90% wet pickup with the following bath and dried and cured for 3 minutes at 320° F.

| | |
|---|---|
| Water | 80.7 grams |
| Irgalan Brown 2RL (C. I. Acid Brown 45) | 0.8 |
| Carboxylated styrene/butadiene latex (Reichold Resin 68-785-Reichold Chemicals Inc.) | 16.0 |
| Nonionic emulsifying wetting agent (Mykon NRW-3-Sun Chemical Corp.) | 0.5 |
| Nonionic softener/lubricant (Softener 634-Laurel Products Corp., Phila. Pa.) | 2.0 |

The fabric was given an afterwash at 120° F. for 5 minutes. The washfastness, color value, and hand were excellent.

EXAMPLE 3

An 8 oz./yd. interlock 50/50 acrylic/cotton fabric was padded with the following bath to a 95% wet pickup and dried and cured for $3\frac{1}{4}$ minutes at 320° F.

| | |
|---|---|
| Water | 78.3 grams |
| Astrazon Red 4G (C.I. Basic Red 14) | 0.7 |
| Butadiene/styrene latex (Good-Rite 1800 × 73 (SBR) - B. F. Goodrich Co.) | 18.0 |
| Methyl vinyl ether/maleic anhydride antimigrant composition (Irgapadol AM-Ciba Geigy Corp.) | 2.0 |
| Nonionic emulsifying wetting agent (Mykon NRW-3-Sun Chemical Co.) | 1.0 |

The fabric was given a 5 minute rinse at 120° F. The hand and fastness properties were very good.

EXAMPLE 4

An 8 oz./yd. 50/50 polyester/cotton interlock fabric was padded with the following bath to a 100% (wpu) and dried and cured for $3\frac{1}{2}$ minutes at 330° F.

| | |
|---|---|
| Water | 77.5 grams |
| Nonionic emulsifying wetting agent (Mykon NRW-3) | 0.5 |
| Irgalan Olive 3BL (C.I. Acid Green 70) | 1.0 |
| Nonionic softener/lubricant (Softener 634-Laurel Products) | 2.0 |
| Triazine-formaldehyde resin (Aerotex Resin 23LF-American Cyanamid Company) | 2.0 |
| Carboxylated styrene/butadiene latex (Reichold 68-785)-Reichold Chemicals Inc. | 14.0 |
| Methyl vinyl ether maleic anhydride antimigrant composition (Irgapadol AM-Ciba Geigy Corp.) | 2.0 |

The fabric was given a 5 minute afterwash at 140° F. The hand and fastness properties were very good.

EXAMPLE 5

A dyebath composition was prepared by adding each ingredient in the order listed:

| | |
|---|---|
| Water, 180° F. | 77.5 grams |
| Premetallized acid dye (C.I. Acid Blue 296) | 5.0 |
| Premetallized acid dye (C.I. Acid Red 399) | 5.0 |
| Premetallized acid dye (C.I. Acid Yellow 235) | 5.0 |
| Water, cold tap | to 1000 total |
| Triazine formaldehyde resin (Aerotex Resin 23LF-American Cyanamid) | 80.0 |
| Leveler - ammonium salt of lauryl alcohol ether sulfanate (Stephanol CA460-Stephen Chemical Corp.) | 5.0 |
| Catalyst (25% ammonium chloride) | 50.0 |

An acrylic face/cotton backing woven fabric is padded with the above dyebath composition at room temperature, directed through an atmospheric steamer for 7–15 minutes, then run through three wash boxes at 140° F. with plain water and then through an extraction roller to remove excess water. The fabric is then oversprayed with a finish bath composition as follows:

| | |
|---|---|
| Water | 976 grams |
| Acrylic emulsion (76 Res 3114-Union 76 Corp.) | 10 |
| Cationic wax emulsion (Nalan W-Dupont) | 5.0 |
| Acetic acid - 56% | 9.0 |

The fabric is then dried at 270° to 300° F. The finish bath treatment imparts enhanced crockfastness to the fabric.

That which is claimed:

1. A method for the continuous dyeing of textile fabrics containing blends of synthetic fibers and cellulosic fibers, characterized in that the fibers of each class are substantially colored such that a union dyeing is obtained, said method comprising:

continuously impregnating a fabric containing a blend of synthetic fibers and cellulosic fibers with a dyebath composition comprising a premetallized dyestuff and a polyvinyl pyrollidone/styrene copolymer resin and subjecting the impregnated fabric to a temperature of from 280° to 400° F. for from about two to about five minutes to dry the fabric and to cure said dyebath composition on the fabric.

2. A method as claimed in claim 1 wherein the step of impregnating the fabric comprises padding the dyebath composition onto the fabric.

3. A method as claimed in claim 1 wherein said step of impregnating the fabric comprises spraying the dyebath composition onto the fabric.

4. A method as claimed in claim 1 wherein the dyebath composition also contains dyebath additives selected from the group consisting of fabric softeners, wetting agents, and soil release compounds.

5. A method as claimed in claim 1 including the additional step of afterwashing the fabric following the drying and curing of the fabric.

6. A method as claimed in claim 1 wherein said dyestuff and said resin are present in the dyebath composition at a concentration of 20–350 grams per liter.

7. A method for the continuous dyeing of textile fabrics containing blends of polyester fibers and cotton fibers, characterized in that the fibers of each class are substantially colored such that a union dyeing is obtained, said method comprising continuously impregnating the fabric with a dyebath composition comprising a premetallized dyestuff and a polyvinyl pyrollidone/styrene copolymer emulsion, and wherein said dyestuff and said resin are present in the dyebath composition at a concentration of 20–350 grams per liter, and subjecting the impregnated fabric to a temperature of from 280° to 400° F. for from two to five minutes to dry the fabric and to cure said dyebath composition on the fabric.

* * * * *

UNITED STATES PATENT AND TRADEMARK OFFICE

CERTIFICATE OF CORRECTION

PATENT NO. : 4,699,625

DATED : October 13, 1987

INVENTOR(S) : Evans M. Jenkins

It is certified that error appears in the above-identified patent and that said Letters Patent is hereby corrected as shown below:

The title of the patent "Method of Continuously Dyeing Fabrics Containing Blends of Synthetic Fibers and Cellulosic Fibers with Premetallized Dye and Polyvinyl Pyrrolison/Styrene Copolymer"

should be

-- Method of Continuously Dyeing Fabrics Containing Blends of Synthetic Fibers and Cellulosic Fibers with Premetallized Dye and Polyvinyl Pyrrolidone/Styrene Copolymer --

Signed and Sealed this

Twelfth Day of April, 1988

*Attest:*

DONALD J. QUIGG

*Attesting Officer*

*Commissioner of Patents and Trademarks*